US007455945B2

(12) United States Patent
Katoh et al.

(10) Patent No.: US 7,455,945 B2
(45) Date of Patent: Nov. 25, 2008

(54) COATED CARRIER AND TWO-COMPONENT DEVELOPING AGENT

(75) Inventors: Takeshi Katoh, Nara (JP); Yoshinori Urata, Kashihara (JP); Kazuya Korematu, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 323 days.

(21) Appl. No.: 11/145,575

(22) Filed: Jun. 6, 2005

(65) Prior Publication Data

US 2005/0277049 A1 Dec. 15, 2005

(30) Foreign Application Priority Data

Jun. 7, 2004 (JP) ..... P2004-168878

(51) Int. Cl.
*G03G 9/113* (2006.01)

(52) U.S. Cl. ..... 430/111.35; 430/111.1; 430/111.32

(58) Field of Classification Search ..... 430/111.1, 430/111.32, 111.33, 111.35
See application file for complete search history.

(56) References Cited

U.S. PATENT DOCUMENTS

| | | | | |
|---|---|---|---|---|
| 6,284,421 | B1 * | 9/2001 | Matsuzaki et al. | 430/111.1 |
| 6,387,582 | B2 * | 5/2002 | Kayamoto et al. | 430/111.1 |
| 2005/0271966 | A1 * | 12/2005 | Urata et al. | 430/111.35 |

FOREIGN PATENT DOCUMENTS

| | | | | |
|---|---|---|---|---|
| JP | 1-105264 | A | | 4/1989 |
| JP | 2-43566 | | | 2/1990 |
| JP | 3-2766 | A | | 1/1991 |
| JP | 03-072372 | | | 3/1991 |
| JP | 4-177369 | | | 6/1992 |
| JP | 2000-221733 | A | | 8/2000 |
| JP | 2000-338710 | A | | 12/2000 |
| JP | 2001-92190 | | | 4/2001 |
| JP | 2002-287431 | A | | 10/2002 |
| JP | 2003-066656 | | | 3/2003 |
| JP | 2003066656 | A | * | 3/2003 |
| JP | 2003-98761 | A | | 4/2003 |
| JP | 2003-255591 | | | 9/2003 |
| JP | 2003-280288 | | | 10/2003 |
| JP | 2004-109159 | | | 4/2004 |
| JP | 2004-144777 | | | 5/2004 |
| JP | 2004-361929 | | | 12/2004 |

OTHER PUBLICATIONS

USPTO STIC provided translation of JP 2003-066656 (2003).*

* cited by examiner

*Primary Examiner*—Christopher RoDee
(74) *Attorney, Agent, or Firm*—Nixon & Vanderhye P.C.

(57) ABSTRACT

A carrier excellent in durability and environmental stability and a two-component developing agent is provided. In the carrier, a core material is coated with a resin, and the coating resin is formed on the core material such that the coating resin comes to be in an amount of 5% by weight to 20% by weight on the basis of a weight of the core material, thereby enhancing durability. Further, the coating resin contains fine particles of titanium oxide, thereby enhancing environmental stability.

4 Claims, No Drawings

COATED CARRIER AND TWO-COMPONENT DEVELOPING AGENT

This application claims priority to JP 2004-168878 filed 7 Jun. 2004, the entire content of which is hereby incorporated by reference.

BACKGROUND OF THE INVENTION

1. Field of the Invention

The present invention relates to a two-component developing agent containing a toner and a carrier and the carrier.

2. Description of the Related Art

An electrophotographic technique to which a Carlson process is applied has widely been used in an image forming method using a developing agent. In an image forming apparatus using the electrophotographic technique, image forming is performed in a charging step, an exposing step, a developing step, a transferring step, a fixing step, a cleaning step and the like. In the charging step, a surface of a photoreceptor is uniformly charged. In the exposing step, an electrostatic latent image is formed on the surface of the photoreceptor by exposing the thus-charged photoreceptor. In the developing step, a visible image is formed by allowing a developing agent such as a toner to adhere to the electrostatic latent image formed on the surface of the photoreceptor. In the transferring step, a toner image is transferred onto a recording material by charging the recording material with a polarity opposite to that of the toner. In the fixing step, the visible image transferred onto the recording material is fixed by applying measures such as heat and pressure. In the cleaning step, the toner left over on the surface of the photoreceptor without having been transferred to the recording material is recovered. By performing these steps, an image forming apparatus making use of an electrophotographic process forms a desired image on the recording material. A developing system based on the electrophotographic technique is roughly divided into a one-component developing system and a two-component developing system.

It has heretofore been known that the developing agent to be used in the image forming apparatus making use of the electrophotographic technique contains the toner to be produced by a crushing method, a polymerization method or the like. The crushing method is a method in which a thermoplastic resin, a coloring agent, a charge control agent, a wax as an anti-offset agent and the like are melt-kneaded, cooled to be solidified to prepare a melt-kneaded product and, then, the thus-prepared melt-kneaded product is crushed and classified, to thereby prepare the toner. Further, the polymerization method is a method in which the toner is prepared by a dispersion polymerization method, an emulsion polymerization method or the like.

Presently, a higher speed and a smaller size of the image forming apparatus such as a copying machine or a printer has been attempted. In order to obtain a high-quality image for a long period of time, development of the developing agent excellent in durability and environmental stability has been required.

In the case of a two-component developing agent consisting of a toner and a carrier, in order to obtain an developing agent excellent in durability and environmental stability, research and development of carriers such as optimization of core material type, coating resin type and coating resin amount is important for the purpose of stably charging a developing agent inside an image forming apparatus as well as research and development of toners.

A typical conventional technique for the development of the carrier is described in Japanese Unexamined Patent Publication JP-A 4-177369. A color developing agent as described in the JP-A 4-177369 is a developing agent containing a toner and a carrier, in which, in the carrier, a carrier core material is coated with a predetermined resin (coating resin) in an amount of 0.1 to 5.0% by weight on the basis of the weight of the carrier core material.

Further, another technique is described in Japanese Unexamined Patent Publication JP-A 2003-255591. A two-component developing agent for electrophotography as described in the JP-A 2003-255591 is a developing agent containing a toner and a carrier, in which, in the carrier, a carrier core material is coated with a coating material (coating resin) in an amount of more than 5.0% by weight on the basis of the weight of the carrier core material.

It is necessary that the developing agent has appropriate fluidity and chargeability such that the toner of the developing agent smoothly adheres to an electrostatic latent image formed on a surface of a photoreceptor. The fluidity and chargeability of the developing agent vary in accordance with compositions of the carrier.

According to the color developing agent as described in Japanese Unexamined Patent Publication JP-A 4-177369, by using the carrier in which the carrier core material is coated with the predetermined resin in an amount of 0.1 to 5.0% by weight on the basis of the weight of the carrier core material, a contamination in which the toner forms a thin film on a surface of the carrier or the like is prevented, to thereby prepare the developing agent excellent in the durability and the environmental stability. However, in recent years, a higher speed operation and a smaller size of the image forming apparatus has been realized. At the time of forming an image by using such image forming apparatus as described above, since a stress to be given to the developing agent comes to be larger than that in the conventional image forming apparatus, the resin is peeled off from the core material in use for a long period of time, to thereby expose the surface of the carrier core material. Namely, in a case of forming the image by using the image forming apparatus which has been down-sized and is capable of performing a high speed operation, the developing agent has an insufficient durability incapable of maintaining carrier characteristics of an initial stage and, then, the image to be obtained causes a low image density or the like.

Further, according to the two-component developing agent for electrophotography as described in Japanese Unexamined Patent Publication JP-A 2003-255591, by coating the carrier core material with a coating material in an amount of more than 5.0% by weight, even when the developing agent is used for a long period of time in the image forming apparatus which has been down-sized and is capable of performing a high speed operation, the surface of the carrier core material is unlikely to be exposed and, accordingly, the developing agent comes to be excellent in durability such that it can maintain the carrier characteristics for a long period of time. However, since the carrier core material is coated with a large amount of the coating material, there is a possibility in that, depending on types of coating materials, carrier characteristics such as environmental characteristics can not be maintained and, further, at the time of forming the image, a toner concentration in the developing agent is not stabilized in a high-temperature high-moisture atmosphere and, then, there is also a possibility of causing toner scattering, background fogging and the like. Therefore, magnetite has externally been added to the toner, to thereby solve such problems as described above.

Further, the inventors have found that, even when a coating amount of the carrier is 5.0% by weight or more on the basis of the weight of the core material, by defining the toner concentration by a coating ratio of the toner to the carrier, the developing agent excellent in the durability and the environmental stability can be obtained.

Namely, in such methods as described above, even when the carrier in which the coating amount is 5.0% by weight or more against the core material is used, by defining the toner added with an external additive or the toner concentration, the environmental stability is allowed to be enhanced.

SUMMARY OF THE INVENTION

An object of the invention is to provide a carrier excellent in durability and environmental stability and a two-component developing agent for electrophotograpy by changing the composition of a carrier.

The invention provides a carrier constituting a two-component developing agent, comprising:

a core material; and a coating resin formed thereon, the coating resin being in an amount of 5% by weight to 20% by weight on the basis of a weight of the core material, and containing fine particles of titanium oxide.

According to the invention, there is provided the carrier in which the core material is coated with a resin. The coating resin is in an amount of 5% by weight to 20% by weight on the basis of the weight of the core material and contains fine particles of titanium oxide.

In order to realize environmental stability, it is necessary to set a toner charging amount to be as high as possible. However, when the toner charging amount is set high, a required image density can not be obtained and, accordingly, it is difficult to allow both characteristics to be simultaneously realized by a conventional design of the carrier.

Then, by adding fine particles of titanium oxide which is a material having a high dielectric constant into the coating resin, the dielectric constant of a developing agent layer is increased, an electric field intensity between a developing sleeve and a photoreceptor is increased and, then, even in a high charging amount, a high developability can be secured.

By forming the coating resin on the core material in an amount of 5% by weight or more on the basis of the weight of the core material, the carrier excellent in durability is prepared and, further, by forming the coating resin on the fine particles of titanium oxide, the carrier excellent in environmental stability is prepared.

Further, in the invention it is preferable that the coating resin contains fine particles of titanium oxide in an amount of 5% by weight to 50% by weight.

Further, according to the invention, by allowing the fine particles of titanium oxide to be contained in the coating resin in an amount of 5% by weight to 50% by weight, the carrier excellent in the environmental stability is prepared.

Further, in the invention, it is preferable that the fine particles of titanium oxide has a width of 0.04 μm to 0.07 μm and a length of 0.2 μm to 0.3 μm.

Further, in the invention, it is preferable that an average particle diameter of the core material has an average particle diameter of 30 μm to 100 μm.

Further, the invention provides a two-component developing agent comprising a toner and the carrier as described above.

Further, according to the invention, there is provided a two-component developing agent comprising a toner and a carrier, and as the carrier is used the carrier as described above. Since the carrier is excellent in durability and environmental stability, the two-component developing agent comes to be excellent in durability and environmental stability.

DETAILED DESCTIPTION OF THE PREFERRED EMBODIMENTS

Now referring to the drawings, preferred embodiment of the invention are described below.

The invention is a carrier in which a core material is coated with a resin containing fine particles of titanium oxide and a two-component developing agent containing the carrier.

(Carrier)

The carrier according to the invention includes a core material and a coating resin formed thereon. The carrier is required to have factors such as powder characteristics, electric characteristics, and magnetic characteristics, also, performance in accordance with a developing system. In recent years, in order to enhance frictional chargeability, the environmental stability and the durability, the carrier in which the core material is coated with the resin has widely been used.

(Resin Coating)

The carrier is constituted by containing the coating resin having fine particles of titanium oxide. As for the coating resin, a known resin can be used. Examples of such resins include a polyester type resin, a fluorine type resin, an acrylic resin and a silicone type resin. Further, coating of the core material is performed by using, for example, a spraying method or a dipping method. Still further, the coating resin may be added with carbon black. By such addition, a charging amount is increased and, then, a stabilized image density can be maintained.

(Fine Particles of Titanium Oxide)

The coating resin is constituted by containing the fine particles of titanium oxide. By allowing the coating resin to contain the fine particles of titanium oxide, the carrier comes to be excellent in environmental stability. The fine particles of titanium oxide are preferably those in which surfaces have been subjected to a hydrophobic treatment. Examples of such hydrophobic treatments include a treatment by a silane coupling agent such as dimethyl dichlorosilane or an amylosilane, a treatment by a silicone oil and a treatment by a fluorine-containing component. Further, it is preferable that the fine particles of titanium oxide are contained in the coating resin in an amount of from 5% by weight to 50% by weight on the basis of the weight of the coating resin. When the amount is less than 5% by weight, an effect to be given to the environmental stability becomes small, while, when the amount is more than 50% by weight, a sufficient image density can not be secured.

As for preferable sizes of the fine particles of titanium oxide, width is 0.04 μm to 0.07 μm and length is 0.2 μm to 0.3 μm.

(Core Material)

The carrier is constituted by containing the core material. As for the core material, a known article can be used. Examples of such core materials include iron powder and ferrite. As for shapes thereof, an amorphous shape to a spherical shape can be used. Further, as for an average particle diameter of the core material, that having an average particle diameter of, preferably, from 10 μm to 1000 μm in general can be used. In the invention, it is preferable that an average particle diameter of the core material is from 30 μm to 100 μm. When the average particle diameter is less than 30 μm, a phenomenon in which the carrier adheres to the photoreceptor and flowed out, namely, carrier flying is generated and, then, when the amount of the developing agent is gradually decreased, a possibility in which the toner concentration in the developing agent cannot appropriately be controlled becomes high. Further, when the carrier flying comes to be conspicuous, the developing agent appears on a recording material. Still further, when the average particle diameter is more than 100 μm, there is a possibility of causing a phenomenon in which, at the time of transferring the toner in the developing agent from a developing roller (developing sleeve) to the photoreceptor, standing-up (magnetic brush) of the two-component developing agent is generated in a coarse manner and, then, it becomes difficult to supply a stable image quality, or the two-component developing agent is spilled off a developing vessel.

Further, as for the iron powder, a known article can be used. Examples of the iron powder include reduced iron powder, atomized iron powder and iron nitride powder. Since the reduced iron powder and the iron nitride powder are amorphous, a conglobation treatment may be performed thereto. As for the carrier of the ferrite, a known article can be used. Examples of ferrite powder include powder of copper, nickel, zinc, cobalt, manganese and calcium. Since the ferrite carrier is spherical and excellent in fluidity and is, also, chemically stable, it is favorably used for realizing a high image quality and a long life.

Toner

The toner which constitutes the two-component developing agent of the invention is constituted by adding an external additive to toner matrix particles containing a birder resin, a coloring agent, a parting agent and a charge control agent.

(Binder Resin)

The toner matrix particles are constituted by containing the binder resin. As for the binder resin, a known resin can be used. Examples of such resins include polystyrene, a styrene-acrylic copolymer, a styrene-acrylonitrile copolymer, a styrene-maleic anhydride copolymer, a styrene-acrylic-maleic anhydride copolymer, a polyvinyl chloride, a polyolefin resin, an epoxy resin, a silicone resin, a polyamide resin, a polyurethane resin, a urethane-modified polyester resin and an acrylic resin. These resins may be used either each individually or in mixtures of a plurality thereof. Further, the copolymer may either be a block copolymer or a graft copolymer. A molecular weight distribution thereof may either have one peak or two peaks.

Further, as for a thermal property, a glass transition point (Tg) is preferably 40° C. to 70° C. In a case in which the glass transition point is less than 40° C., when a temperature inside the image forming apparatus is increased, the toner is melt and toners are agglomerated with each other. Further, in a case in which the glass transition point is more than 70° C., a fixing property is deteriorated and, therefore, the case is hardly practical.

(Coloring Agent)

The toner matrix particles are constituted by containing the coloring agent. As for the coloring agent, a known article can be used. Examples of such coloring agents include carbon black, iron black, an alloy azo dye, an oil-soluble dye and a pigment. The coloring agent is preferably in an amount of 1 part by weight to 10 parts by weight on the basis of 100 parts by weight of the binder resin. When the amount is less than 1 part by weight, a sufficient image density can not be secured, while, when the amount is more than 10 parts by weight, the coloring agent can not uniformly be dispersed and, then, a high-quality image can not be obtained.

(Parting Agent)

The toner matrix particles are constituted by containing a wax as a parting agent. As for the wax, a known article can be used and, for example, at least one type of wax selected from among polyethylene, polypropylene, an ethylene-propylene copolymer and a polyolefin can be mentioned. The wax is preferably in an amount of 1 part by weight to 10 parts by weight on the basis of 100 parts by weight of the binder resin. when the amount is less than 1 part by weight, an offset phenomenon tends to be generated, while, when the amount is more than 10 parts by weight, filming tends to be generated.

(Charge Control Agent)

The toner matrix particles are constituted by containing the charge control agent. In the charge control agent, there are two types of a charge control agent for positive charge control and a charge control agent for negative charge control. Examples of such charge control agents include an azo type dye, a metal complex of a carboxylic acid, a quaternary ammonium compound and a nigrosine type dye. The charge control agent is used preferably in an amount of 0.1 part by weight to 5 parts by weight on the basis of 100 parts by weight of the resin. When the amount is less than 0.1 part by weight, a sufficient chargeability can not be imparted, while, when the amount is more than 5 parts by weight, the charge control agent can not uniformly be mixed in the resin.

(External Additive)

The toner is constituted by adding the external additive to the toner matrix particles. As for the external additive, a known article can be used. Examples of such external additives include fine particles, namely, fine particles of metallic oxides such as silica, titanium oxide, alumina, magnetite and ferrite, fine particles of metallic nitrides such as silicon nitride and boron nitride. Further, surfaces of the fine particles have preferably been subjected to a hydrophobic treatment. Examples of such hydrophobic treatments include a treatment by a silane coupling agent such as dimethyl dichlorosilane or an amylosilane, a treatment by a silicone oil and a treatment by a fluorine-containing component. These external additives may be used either each individually or in combinations of two types or more thereof. Further, as for the external additive, silica is more preferred. Even when any other fine particles than silica are solely externally added, there are some cases in which a sufficient charge is not imparted to a contact between the toner and the carrier and, further, since silica also acts as a fluidizing agent, silica can stabilize an amount of the toner to be supplied.

(Production Method)

The resin, the coloring agent, the parting agent, the charge control agent and the like are sufficiently mixed by using a mixer such as a Henschel mixer or a super mixer and, then, the resultant mixture is melt-kneaded by using a twin-screw kneader. The thus-kneaded article is crushed by using a jet crusher and classified, to thereby obtain toner matrix particles having a volume average particle diameter of 5 μm to 15 μm. Further, inorganic fine particles are added to the toner matrix particles, allowed to uniformly adhere thereto and, then, to be uniformly dispersed by using the Henschel mixer or the super mixer, to thereby produce the toner.

Two-Component Developing Agent

The two-component developing agent according to the invention can be produced by mixing the toner and the carrier by means of the mixer such that a specified toner concentration is derived therefrom. As for the mixer, a known apparatus can be used. For example, a Nauta mixer (VL-0: trade name; manufactured by Hosokawa Micron Corporation) can be mentioned.

EXAMPLES

Hereinafter, the invention is specifically described with reference to Examples and Comparative Examples and is not limited thereto unless departing from the purport of the invention.

Example A

In Example A, an influence of a carrier coating amount of a carrier constituting a two-component developing agent was studied.

(Production Example of Toner)

1.0 part by weight of polyethylene (trade name: PE130; manufactured by Clariant (Japan) K.K.) and 1.5 parts by weight of polypropylene (trade name: NP-505; manufactured by Mitsui Chemicals, Inc.) as waxes, 5 parts by weight of carbon black (trade name: 330R; manufactured by Cabbot Speciality Chemicals, Inc.) as a coloring agent, 1 part by weight of a charge control agent (trade name: S-34; manufactured by Hodogaya Chemical Co., Ltd.), 1.5 parts by weight of Magnetite (trade name: KBC-100; manufactured by Kanto Denka Kogyo Co., Ltd.) were added to 100 parts by weight of a resin, fully mixed by using a super mixer (trade name: V-20; manufactured by Kawada K.K.) and, then, the resultant mixture was melt-kneaded by using a twin-screw kneader (trade name: PCM-30; manufactured by Ikegai Corporation). The resultant kneaded article was crushed by using a jet type crusher (trade name: IDS-2; manufactured by Nippon Pneumatic Mfg., Co., Ltd.) and classified, to thereby obtain toner matrix particles having a volume average particle diameter of 7.5 μm. Thereafter, 0.3 part by weight of silica fine particles (trade name: R972; manufactured by Nippon Aerosil Co., Ltd.) were externally added to the thus-obtained toner matrix particles, to thereby prepare a toner.

(Production Example of Carrier)

A silicone resin (trade name: KR-255; manufactured by Shin-etsu Chemical Co., Ltd.) as a coating resin was added with carbon black (trade name: Ketchen black EC; manufactured by Lion Corporation) such that carbon black came to be 5% by weight and the resultant mixture was dispersed in toluene, to thereby obtain a dispersion solution. The thus-obtained dispersion solution was applied on a ferrite core material having a particle diameter of 90 μm by using a fluid bed type coating apparatus, heated for 2 hours at 250° C. for curing the resin thus coated, to thereby obtain a carrier.

Example 1

The toner obtained in such manner as described above and a ferrite carrier which has been coated with the coating resin such that, as described in Table 1, a carrier coating amount was allowed to be 8.0% by weight were mixed for 20 minutes by using a Nauta mixer (trade name: VL-0; manufactured by Hosokawa Micron Corporation) such that the toner concentration came to be 5%, to thereby produce a two-component developing agent.

Example 2

A two-component developing agent was produced in a same manner as in Example 1 except that the carrier coating amount of the carrier was allowed to be 5.0% by weight.

Comparative Example 1

A two-component developing agent was produced in a same manner as in Example 1 except that the carrier coating amount of the carrier was allowed to be 4.1% by weight.

Comparative Example 2

A two-component developing agent was produced in a same manner as in Example 1 except that the carrier coating amount of the carrier was allowed to be 2.2% by weight.

[Evaluation Method]

By using the two-component developing agents obtained by the production methods, an original document having a print ratio of 5% was copied by printing by using a black-and-white copying machine (trade name AR-450; manufactured by Sharp Corporation).

Changes of the image densities on Examples 1 and 2 and Comparative Examples 1 and 2 were evaluated in such manner as described below. Physical properties of the two-component developing agents obtained by the production methods were evaluated in accordance with evaluation methods as described below and the results are shown in Table 1. Further, symbols "○", "x" and the like described in explanations of evaluation items are symbols which represent evaluation results shown in Table 1. "○" represents being excellent; and "x" represents being difficult for practical use.

(Image Density)

An image density of an image printed out by using a developing agent of an initial stage and another image density of the image after 100,000 copies of an original document having a print ratio of 5% were made by printing with an interval every 5 sheets (image density after 100000 sheets were printed) were measured by using a Macbeth reflectodensitometer (trade name: RD-914; manufactured by Macbeth Co., Ltd.). Evaluations were performed in accordance with the following criteria on the basis of the image density after 100000 sheets were printed:

TABLE 1

| | Carrier | Image density | | |
|---|---|---|---|---|
| | coating amount (% by weight) | Initial | After 100000 sheets | Evaluation |
| Example 1 | 8.0 | 1.38 | 1.33 | ○ |
| Example 2 | 5.0 | 1.36 | 1.30 | ○ |
| Comparative Example 1 | 4.1 | 1.36 | 1.15 | X |
| Comparative Example 2 | 2.2 | 1.37 | 1.10 | X |

○: Image density is 1.30 to less than 1.32; and
X: Image density is less than 1.30.

As is found from Table 1, the developing agent (Examples 1 and 2) using the carrier in which the coating resin is 5% by weight or more on the basis of the weight of the core material was an excellent developing agent in durability capable of maintaining the image density even after 100000 sheets were printed. On the other hand, the developing agent (Comparative Examples 1 and 2) using the carrier in which a coating material was less than 5% by weight on the basis of the weight of the core material has decreased the image density to a large extent after 100000 sheets were printed.

Example B

In Example B, an influence of an amount of fine particles of titanium oxide to be added in a coating resin of a carrier was studied.

Example 3

Production was performed in a same manner as in the toner production methods which have been used in Examples 1 and 2 and Comparative Examples 1 and 2 except for changing crushing conditions such as air pressure at the time of crushing a kneaded article by using a jet type crusher (trade name: IDS-2; manufactured by Nippon Pneumatic Mfg., Co., Ltd.). By the production, toner matrix particles having a volume average particle diameter of 8.5 μm were obtained and, then, externally added with 0.3 part of silica fine particles (trade name: R972; manufactured by Nippon Aerosol Co., Ltd.), to thereby obtain a toner.

A silicone resin (trade name: KR-255; manufactured by Shin-etsu Chemical Co., Ltd.) as a coating resin was added with fine particles of titanium oxide (trade name: TTO-D-1; manufactured by Ishihara Sangyo Kaisha, Ltd.) and carbon black (trade name: Ketchen black EC; manufactured by Lion Corporation) such that fine particles of titanium oxide and carbon black came to be 30% by weight and 5.0% by weight, respectively, and, then, the resultant mixture was dispersed in toluene. The thus-obtained dispersion solution was applied on a ferrite core material having a particle diameter of 90 μm by using a fluid bed type coating apparatus such that the carrier coating amount came to be 6.0% by weight, heated for 2 hours at 250° C. for curing the resin thus coated, to thereby obtain a carrier.

The thus-obtained toner and carrier were mixed for 20 minutes by using a Nauta mixer (trade name: VL-0; manufactured by Hosokawa Micron Corporation) such that the toner concentration came to be 5%, to thereby produce a two-component developing agent.

Example 4

A two-component developing agent was produced in a same manner as in Example 3 except that the fine particles of titanium oxide in the coating resin were added such that it came to be 1% by weight in place of 30% by weight.

Example 5

A two-component developing agent was produced in a same manner as in Example 3 except that the fine particles of titanium oxide in the coating resin were added such that it came to be 4% by weight in peace of 30% by weight.

Example 6

A two-component developing agent was produced in a same manner as in Example 3 except that the fine particles of titanium oxide in the coating resin were added such that it came to be 5% by weight in place of 30% by weight.

Example 7

A two-component developing agent was produced in a same manner as in Example 3 except that the fine particles of titanium oxide in the coating resin were added such that it came to be 50% by weight in place of 30% by weight.

Example 8

A two-component developing agent was produced in a same manner as in Example 3 except that the fine particles of titanium oxide in the coating resin were added such that it came to be 55% by weight in place of 30% by weight.

Comparative Example 3

A two-component developing agent was produced in a same manner as in Example 3 except that the fine particles of titanium oxide were not added in the coating resin.

Evaluation Method

On Examples 3 to 8 and Comparative Example 3 in Table 2, an environmental stability evaluation and an image density evaluation were performed as described below. The physical property evaluations on the two-component developing agents produced by such methods as described above were performed in accordance with an evaluation method as described below. The results are shown in Table 2. Further, symbols "◎", "○" and "x" described in explanation of evaluation items are symbols which represent evaluation results shown in Table 2. "◎" represents being remarkably excellent, "○" represents being excellent, and "x" represents being difficult for practical use. Further, in a comprehensive evaluation, "○" represents being possible for practical use; and "x" represents being difficult for practical use.

(Environmental Stability)

After the two-component developing agent was set and, then, left to stand for 17 hours under a high-temperature high-moisture (35° C., 85%) atmosphere, a toner supply time is measured, background fogging of the image which has been printed after such 17-hour-leaving was measured by using a Hunter whiteness meter (Nippon Denshoku Inds., Co., Ltd.) and, then, the results were evaluated in accordance with the following criteria:

◎: a value of background fogging is less than 0.5;

○: a value of background fogging is 0.5 to less than 1.0; and

X: a value of background fogging is 1.0 or more.

The term "toner supply time" as used herein means a time duration of from the time in which the two-component developing agent started to be stirred to the time in which the toner of the two-component developing agent adhered to the photoreceptor, namely, the supply time of the toner. The difference of the time is due to changes of fluidity and chargeability of the two-component developing agent generated after being left to stand for a long period of time under a high-temperature high-moisture atmosphere.

(Image Density)

The image density at the initial stage was measured in a same manner as in the image density change evaluation and, then, the thus-measured image density was evaluated in accordance with the following criteria:

TABLE 2

| | Titanium oxide content (% by weight) | Environmental characteristics: Supply time (second) | Background fogging | Evaluation | Image density: Initial | Evaluation | Comprehensive evaluation |
|---|---|---|---|---|---|---|---|
| Example 3 | 30 | 4 | 0.21 | ◎ | 1.36 | ◎ | ◎ |
| Example 4 | 1 | 22 | 0.75 | ○ | 1.38 | ◎ | ○ |
| Example 5 | 4 | 15 | 0.61 | ○ | 1.38 | ◎ | ○ |
| Example 6 | 5 | 7 | 0.43 | ◎ | 1.37 | ◎ | ◎ |
| Example 7 | 50 | 4 | 0.20 | ◎ | 1.35 | ◎ | ◎ |
| Example 8 | 55 | 3 | 0.25 | ◎ | 1.33 | ○ | ○ |
| Comparative Example 3 | 0 | 32 | 1.23 | X | 1.39 | ◎ | X |

◎: an image density was 1.35 or more;
○: an image density was 1.30 to less than 1.35; and
X: an image density was less than 1.30.

As is found from Table 2, when the fine particles of titanium oxide were contained in the coating resin (Examples 3 to 8), the two-component developing agents were excellent in the environmental stability and the image density. Further, when the content of the fine particles of titanium oxide is in the favorable range of from 5% by weight to 50% by weight (Examples 3, 6 and 7), the two-component developing agents were more favorable in the environmental stability.

Further, when the fine particles of titanium oxide were not contained in the coating resin (Comparative Example 3), since the carrier coating amount is 5% by weight or more, the two-component developing agent was excellent in the image density. However, since titanium oxide was not contained in the coating resin, the two-component developing agent was inferior in the environmental stability.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A carrier constituting a two-component developing agent, comprising:

a core material; and a coating resin formed thereon, the coating resin being in an amount of 5% by weight to 20% by weight on the basis of a weight of the core material, and containing carbon black and fine particles of titanium oxide subjected to a hydrophobic treatment, wherein the fine particles of titanium oxide has a width of 0.04 μm to 0.07 μm and a length of 0.2 μm to 0.3 μm.

2. The carrier of claim 1, wherein the coating resin contains fine particles of titanium oxide in an amount of 5% by weight to 50% by weight.

3. The carrier of claim 1, wherein an average particle diameter of the core material has an average particle diameter of 30 μm to 100 μm.

4. A two-component developing agent comprising:

a toner; and the carrier of claim 1.

* * * * *